US006578366B1

(12) United States Patent
Christiansen et al.

(10) Patent No.: US 6,578,366 B1
(45) Date of Patent: Jun. 17, 2003

(54) DEVICE FOR EVAPORATION OF LIQUEFIED NATURAL GAS

(75) Inventors: Per Erik Christiansen, Moss (NO); Olav Natvig Bækken, Lærdal (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 10/030,264

(22) PCT Filed: Jul. 10, 2000

(86) PCT No.: PCT/NO00/00234

§ 371 (c)(1),
(2), (4) Date: Feb. 21, 2002

(87) PCT Pub. No.: WO01/03793

PCT Pub. Date: Jan. 18, 2001

(30) Foreign Application Priority Data

Jul. 9, 1999 (NO) ..... 19993389

(51) Int. Cl.[7] ..... F17C 9/02
(52) U.S. Cl. ..... 62/50.2; 62/53.2
(58) Field of Search ..... 62/50.2, 53.2

(56) References Cited

U.S. PATENT DOCUMENTS 3,266,261 A 8/1966 Anderson
3,738,353 A * 6/1973 Santoleri ..... 261/77
3,986,340 A 10/1976 Bivins, Jr.
4,170,115 A * 10/1979 Ooka et al. ..... 62/52
4,224,802 A 9/1980 Ooka
6,003,603 A 12/1999 Breivik et al.
6,089,022 A * 7/2000 Zednik et al. ..... 60/641.7

FOREIGN PATENT DOCUMENTS

DE 29 12 321 10/1979
JP 11-148599 6/1999
NO 179986 10/1996

* cited by examiner

*Primary Examiner*—William C. Doerrler
*Assistant Examiner*—Malik N. Drake
(74) *Attorney, Agent, or Firm*—Birch, Stewart, Kolasch & Birch, LLP

(57) ABSTRACT

A device for evaporation of liquefied natural gas (LNG) on board a vessel. The device includes a pipeline through which LNG flows. The outside of the pipeline may be brought in contact with a heating medium, for example seawater. The pipeline is immersed in the sea and is connected to the vessel. The pipeline is enclosed by a shell through which seawater is pumped by a pump, which is operated by a motor on board the vessel.

1 Claim, 1 Drawing Sheet

DEVICE FOR EVAPORATION OF LIQUEFIED NATURAL GAS

This application is the national phase under 35 U.S.C. § 371 of PCT International Application No. PCT/NO00/00234 which has an International filing data of Jul. 10, 2000, which designated the United States of America and was published in English.

FIELD OF THE INVENTION

1. Description of the Prior Art

The invention relates to a device for evaporation of liquefied natural gas (LNG), which device via pipes is connected to a vessel moored by means of anchor chains, comprising at least one pipe through which LNG flows, the outside of said pipe may be brought in contact with sea water as a heating medium.

Seawater-heated vaporisers, located on shore, are presently in use on land-based LNG receiving terminals, where the vaporised gas, hereafter referred to as NG is transported to consumer via the pipeline system.

Such receiving terminals may comprise insulated tanks for receiving LNG from the vessel, a vaporiser or heat exchanger for vaporisation of LNG, and a control -and metering module for adjustment and metering of the gas which is passed to the consumer pipelines.

The known vaporiser comprises pipes, which are sprinkled with seawater. The heat energy of the seawater is transferred to the LNG located inside the pipe, which causes heating of the LNG that in turn leads to evaporation and superheating of the LNG towards ambient temperature. The difference in temperature between LNG and vaporised/superheated gas is approximately 170–180° C. Maximum energy transfer from the seawater corresponds to a temperature reduction of 5–8° C. The flow rate of circulating seawater therefore has to be significantly larger than the flow rate of LNG/NG, which is vaporised and superheated. The seawater is taken from the sea in the vicinity of the terminal and is returned to an area as far from the inlet as necessary to prevent mixing and short-circuiting.

Several disadvantages are related to the known vaporiser.

Due to the small temperature difference available, the seawater volume has to be disproportionally large. This leads to high power requirements to run the circulation pumps and therefore to a low energy efficient process.

Long inlet and outlet pipes with large diameters are required for supply and return of the seawater to a location at large depth in the sea in order to prevent detrimental environmental consequences for the shore zone. This increases the requirement for large pumps and results in long pipelines.

In addition, strainers and devices for prevention of clogging and fouling inside the pipes are required.

To protect the seashore long pipelines with large diameters are also required onshore.

Devices of the known type therefore occupy a large area and are expensive to install and operate.

JP-A-11,148,599 describes a device suitable for evaporation of liquefied natural gas (LNG) connected to a vessel moored by means of anchor chains, comprising at least one pipe through which LNG flows, the outside of said pipe may be brought in contact with seawater as a heating medium, the pipe is immersed in the sea and connected to the vessel, and the pipe is enclosed by a tubular shell through which the seawater is pumped by means of a propeller which is operated by a motor installed on board the vessel.

BRIEF SUMMARY OF THE INVENTION

The objective of the invention is to provide a device of the above-mentioned type, but which does not include the mentioned disadvantages, and which should also contribute in holding mooring cables tight and straight.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The objective of the invention is fulfilled by a device according to claim 1.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
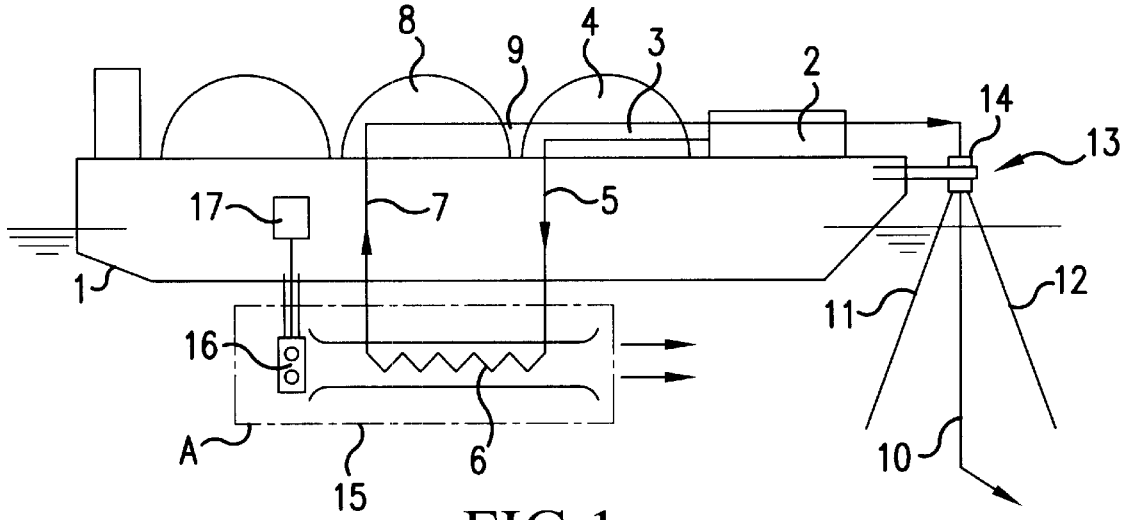
FIG. 1 is a schematic side elevation showing a floating vessel, which carries a device according to the invention.

A vessel 1 which may be anchored near a jetry (not shown) or moored to it comprises a control- and metering device 2, for receiving LNG which is pumped from the supply ship (not shown), and for discharge NG to the consumer pipe network pipelines (not shown) anchors.

From the control- and metering device 2 a line 3 is extending to a tank 4, in which the LNG is stored, and from tank 4, a pipe 5 leads to one end of a pipe or pipe device 6, which is immersed in the sea beneath the vessel 1, and which acts as a vaporiser. From the other end of pipe 6, a pipe 7 leads to for example a storage tank 8 for NG, and from this tank 8 a pipe 9 leads to the regulator and metering device 2. From the control -and metering device 2, a pipe 10 is leading to one or more consumers of NG, for example via a consumer pipe network system anchors (not shown). The vessel is moored by means of anchor chains, 11, 12 which are connected to the vessel at a location 13. At said location 13, a swival 14 may be arranged for the anchor chains 11, 12 and the line 10, so that the vessel may rotate around this point, for example under the influence of wind without twisting of anchor cables and the pipe.

A tubular shell 15 encloses the pipe 6. A propeller 16 which may be operated by means of a motor 17 on board the vessel 1, is arranged at an end of the shell 15, which faces away from the mooring cables 11, 12. By operating the propeller 16, seawater is forced through the casing 15 and around the pipe 6 in a direction towards the mooring cables 11, 12. In this manner the propeller provides a current of relatively warm seawater around the pipe 6 causing evaporation of LNG, and at the same time provides a thrust on the vessel 1 away from the mooring cables 11, 12, holding them tight and straight.

The shown device functions as follows.

From a ship transporting the LNG and which has been moored close to the vessel 1, a pipe (not shown) is being connected to the control -and metering device 2. Subsequently LNG is pumped from the ship to the LNG tanks 4 of the vessel, from where LNG may be pumped to the pipe or pipe device 6. This is of sufficient length that all LNG which is introduced at the inlet has been evaporated to NG at the pipe exit. This evaporation is caused by seawater, which is forced through the shell by means of the propeller 16 and transfers a part of its heat energy and is thereby reduced in temperature.

The produced NG is subsequently transported to the tank 8 used for storing of NG, from where NG is further transported to the control -and metering device 2. The amount, which is to be supplied to the consumer pipe network via line 10, is at this point measured and metered.

Typical seawater temperatures at the inlet of the shell may be 15° C., and at the shell exit approximately 5° C.

It is to be understood that by arranging the evaporating pipe or evaporating system 6 near the vessel 1, there is no need for long pipelines, which is the case for the known technique. It is further to be understood that the plant may function without the collecting tanks 4 respectively 8, as LNG and NG may be pumped directly to and from the pipe 6 via the control -and metering device 2. It is also to be understood that the power requirement for pumping of LNG through this vaporiser is considerably less than the power requirement of a traditional evaporator as described above. Investment cost as well as operating costs are therefore considerably less than traditional vaporising installations. There are also far less environmental effects.

Figure 2:
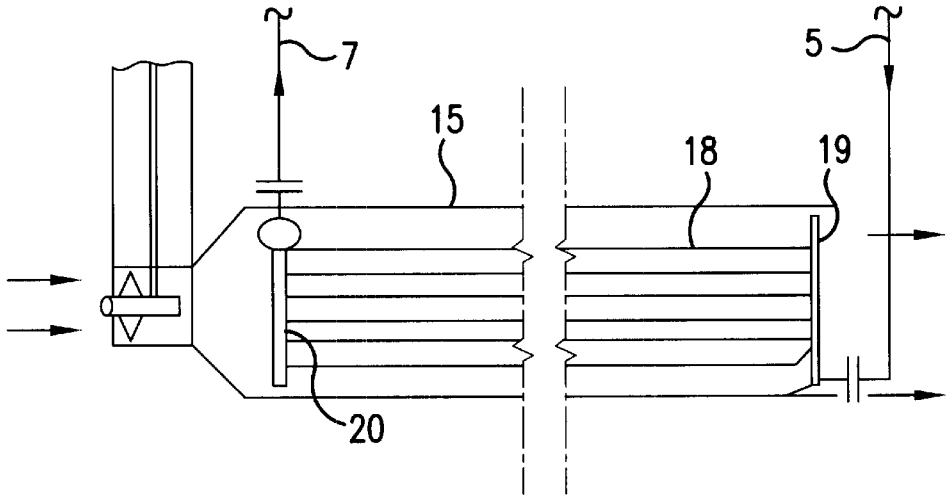
FIG. 2 is an enlarged sketch of the section which in FIG. 1 is designated A.

FIG. 2 is an enlarged sketch of the section, which in FIG. 1 is designated A. It is shown that a pipe arrangement 6 of the vaporiser may comprise a series of single pipes 18 that pass between a inlet manifold 19 and an outlet manifold 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for evaporation of liquefied natural gas (LNG), which device via pipes is connected to a vessel moored by anchor chains, comprising at least one pipe through which LNG flows, the outside of said pipe may be brought into contact with sea water as a heating medium, the pipe is immersed in the sea and connected to the vessel, and the pipe is enclosed by a tubular shell, through which said shell sea water is pumped by a propeller or by natural water flow, which may be operated by a motor installed on board the vessel, wherein the propeller is arranged at an end of the shell which faces away from the mooring cables, and, by operating the propeller, seawater is forced through the shell and around the pipe in a direction towards the mooring cables, the propeller provides a current of relatively warm seawater around the pipe causing evaporation of LNG, and at the same time provides a thrust on the vessel away from the mooring cables, holding them tight and straight.

* * * * *